US007053535B2

(12) United States Patent
Lauwerijssen et al.

(10) Patent No.: US 7,053,535 B2
(45) Date of Patent: May 30, 2006

(54) LOW-PRESSURE MERCURY VAPOR DISCHARGE LAMP

(75) Inventors: Petrus Cornelis Lauwerijssen, Roosendaal (NL); Marinus Cornelis Michiel Neelen, Roosendaal (NL); Johannes Theodorus Jacubus Van Haastrecht, Roosendaal (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 169 days.

(21) Appl. No.: 10/479,090

(22) PCT Filed: May 27, 2002

(86) PCT No.: PCT/IB02/01874

§ 371 (c)(1),
(2), (4) Date: Nov. 25, 2003

(87) PCT Pub. No.: WO02/099843

PCT Pub. Date: Dec. 12, 2002

(65) Prior Publication Data

US 2004/0145318 A1 Jul. 29, 2004

(30) Foreign Application Priority Data

Jun. 1, 2001 (EP) ..... 01202112

(51) Int. Cl.
*H01J 1/88* (2006.01)

(52) U.S. Cl. ..... 313/151; 313/274

(58) Field of Classification Search ..... 313/151, 313/274, 292, 491, 492, 493, 552, 631, 628
See application file for complete search history.

(56) References Cited

U.S. PATENT DOCUMENTS 2,351,305 A * 6/1944 Thayer ..... 315/56
3,619,697 A * 11/1971 Evans ..... 313/144
4,097,779 A * 6/1978 Latassa ..... 315/106

FOREIGN PATENT DOCUMENTS

JP 55144650 A * 11/1980
JP 57132661 A * 8/1982

* cited by examiner

*Primary Examiner*—Ashok Patel

(57) ABSTRACT

A low-pressure mercury vapor discharge lamp includes a discharge vessel having two end portions. An electrode carrier is arranged in an end portion and carries an electrode for generating and maintaining a discharge in the discharge vessel. The electrode carrier is at least partly made of a bimetal or a memory metal, and is formed such that the distance between electrode and the far end of the end portion increases if the temperature of electrode carrier increases.

20 Claims, 3 Drawing Sheets

LOW-PRESSURE MERCURY VAPOR DISCHARGE LAMP

The invention relates to a low-pressure mercury vapor discharge lamp comprising a discharge vessel having two end portions, wherein an electrode carrier is arranged in an end portion, which electrode carrier carries an electrode for generating and maintaining a discharge in the discharge vessel, and said electrode carrier is at least partly made of a bimetal or a memory metal.

Such a lamp is known from Japanese patent application JP-A-55144650. In this fluorescent lamp, the electrode carriers in both end portions, which electrode carriers are also the current supply conductors for the electrode, are made of a bimetal and formed such that the distance between the electrodes in both end portions increases if the temperature increases, so that in the case of a cold start of the lamp, the electrodes are closely spaced, and a higher temperature in the lamp leads to a longer discharge path. It is assumed to be well known that a bimetal is an elongated piece of material that is composed of two parts of different metal alloys, each part having a different coefficient of expansion, causing the piece of material to deform under the influence of a change in temperature. A well-known alternative to such a bimetal is memory metal. A memory metal has two different crystal structures that blend with each other at a more or less accurately defined temperature limit at which an object made of such a memory metal changes shape. A limitation of a memory metal relative to a bimetal resides in that instead of a gradual deformation in dependence upon temperature, it suddenly changes from one extreme shape to the other.

In mercury vapor discharge lamps, mercury is the primary component for (efficiently) generating ultraviolet (UV) light. The inner wall of the discharge vessel may be coated with a luminescent layer comprising a luminescent material (for example a fluorescent powder, which is the reason why such lamps are also referred to as fluorescent lamps) for converting UV to other wavelengths, for example UV-A and UV-B for tanning purposes (sunbed lamps) or to visible radiation for general lighting purposes. The discharge vessel of low-pressure mercury vapor discharge lamps is generally circular in cross-section and includes both elongated embodiments (fluorescent tubes) and compact embodiments (low-energy light bulbs). In the fluorescent tube, said tubular end portions are coaxial and form an elongated, straight tube, while, in a low-energy light bulb, these tubular end portions are interconnected by means of a bent tubular portion or a so-termed bridge.

The low-pressure mercury vapor discharge lamp is evacuated in the production process by means of the glass exhaust tubes situated at both ends of the lamp. Subsequently, the desired gas mixture is fed into the lamp through said exhaust tubes, after which these exhaust tubes are pinched and sealed.

In operation, a voltage is maintained between the electrodes that are also situated at both ends of the lamp, as a result of which continuous discharge takes place and the mercury vapor emits said UV light.

The discharge vessel of a mercury-vapor discharge lamp thus comprises a quantity of mercury which, in the cold state, deposits as droplets on the coldest part of the lamp. Many low-pressure mercury vapor discharge lamps are formed such that said part constitutes the end of the end portion of the discharge vessel. In operation, said liquid mercury heats up and evaporates, as a result of which the required mercury vapor pressure is obtained. This mercury vapor pressure depends on the temperature of the mercury droplets and hence on the temperature of the end of the end portion of the discharge vessel. This temperature substantially depends on the temperature of the electrode.

In high-power lamps, the electrode heats up to a higher temperature than in low-power lamps. In order to attain the optimum mercury vapor pressure at each power level, the electrode carriers in high power lamps customarily have a greater length than in low-power lamps, as a result of which the distance between the hot electrode and the mercury droplets at the end of the end portion is larger and the heat transfer to the mercury droplets is smaller, so that the mercury vapor pressure in the lamp does not become excessively high.

As dimmer devices are used more and more for such lamps, there is a need for a low-pressure mercury vapor discharge lamp that is suitable for different electric power levels. This has the additional advantage that it enables a reduction of the number of different types of lamps to be manufactured. Therefore, it is an object of the invention to provide a low-cost, reliable lamp wherein the mercury vapor pressure is largely constant at different temperatures of the electrodes.

To achieve this, the electrode carrier is formed such that the distance between the electrode and the end of the end portion increases if the temperature of the electrode carrier increases. In this manner it is achieved that the temperature of the mercury droplets present on the end remains at least substantially constant if, at a higher power level, the electrode carrier heats up due to the increase in temperature of the electrode, and hence the mercury vapor pressure in the lamp remains more or less constant.

Preferably, the sectional dimension of the current supply conductors is so small that the current supply conductors are capable of causing the temperature of the electrode carrier to increase through electric resistance. In this manner it is achieved that, apart from the fact that the radiant and conduction heat from the electrode contribute to the deformation of electrode carriers, said carriers are also influenced in a direct way by a change of the power or current sent through the lamp.

Preferably, the electrode carrier is formed such that the distance between the electrode and the end of the end portion can increase by maximally 3–10 mm, preferably 4–8 mm, as a result of an increase in temperature, which values prove to be suitable in practice to maintain the desired vapor pressure at different power levels through the lamp.

In a first preferred embodiment the electrode carrier is at least partly curved in shape, in a second preferred embodiment the electrode carrier is helical, and in a third preferred embodiment it is spiral-shaped. In a fourth preferred embodiment, the electrode carrier comprises a strip of said bimetal or memory metal that is folded so as to be zigzag-shaped. However, to achieve the desired purpose many different shapes of the electrode carrier are conceivable. In a particular preferred embodiment, the electrode carriers, which also serve as current supply conductors, comprise a first carrying wire that is made of a customary conventional metal and extends through the end of the end portion of the discharge vessel, and a second carrying part of said bimetal or memory metal is attached onto the ends of this first carrying wire, the electrode subsequently being secured onto the end of said second carrying part. Preferably, the second carrying part and the electrode extend substantially in the same plane extending perpendicularly to the axis of the end portion of the discharge vessel.

Preferably, the bimetal comprises an iron-nickel alloy, and also preferably, the active part of the bimetal additionally comprises manganese, copper and/or chromium. An example of such an iron-nickel alloy which can suitably be used for the "passive" part of the bimetal is commercially available under the trade name Invar, which comprises 36% nickel and 64% iron. The "active" part comprises, for example, 33% nickel, 60% iron and 7% manganese.

These and other aspects of the invention are apparent from and will be elucidated with reference to the embodiment(s) described hereinafter.

Figure 1:
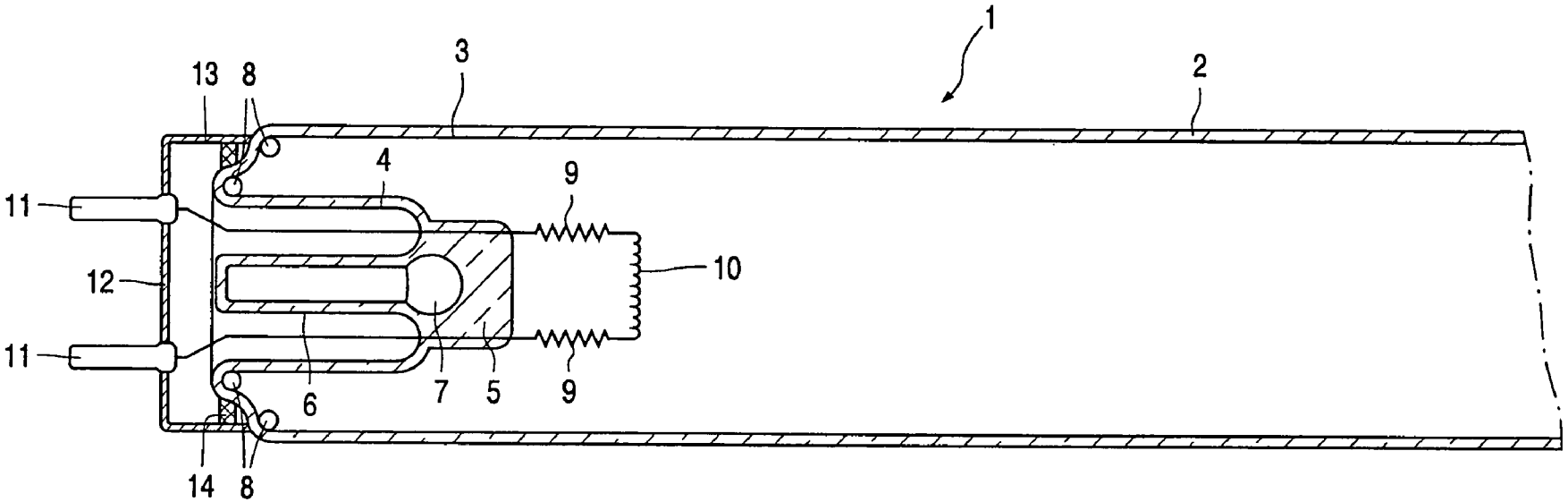
FIG. 1 is a cross-sectional view of a part of a low-pressure mercury vapor discharge lamp.

In accordance with FIG. 1, a low-pressure mercury vapor discharge lamp 1 comprises a glass discharge vessel in the form of a tube 2. Said Figure only shows an end portion 3 of the lamp 1, but the lamp actually comprises two opposing identical end portions 3, which each close one side of an elongated glass tube 2. The inner side of the glass tube 2 is provided with a layer of a fluorescent material, which is capable of converting UV light to UV-A, UV-B or visible light.

At its end, the glass tube 2 comprises an inward cylindrical carrier 4 onto which a pedestal 5 (also referred to as "pinch") is provided after electrode carriers 9 have been fused into said pinch. A tubular exhaust tube 6 extending towards the exterior is provided on the pinch 5, which exhaust tube 6 is in open communication with the content of the tube 2 by means of a hole 7 in the pinch 5. Prior to final assembly of the lamp 1, the tube 2 is evacuated by the exhaust tube 6, which at that stage has a greater length than shown here, and the tube 2 is filled with the desired (inert) gas mixture. Also a quantity of mercury is introduced into the discharge vessel, said mercury, upon cooling, depositing on the coldest parts of the discharge vessel in the form of mercury droplets 8. In general, these coldest parts are situated at the ends of the end portions 3 of the discharge vessel 2. Next, the exhaust tube 6 is heated, so that the glass softens, and subsequently pinched at the length shown and sealed off, as a result of which the tube 2 is sealed in an airtight manner.

The lamp 1 is additionally provided, on both sides, with two electrode carriers 9 which also deliver current to the electrode 10 and which are alternatively referred to as pole wires, and with an electrode 10 consisting of a tungsten spiral-shaped wire. The electrode 10 is covered with a layer of an emitter material (comprising, inter alia, barium, strontium, calcium and different oxides) to enhance the emission of electrons. The electrode carriers 9 are held by the pinch 5 into which the wires are sealed close to the sides, and the electrode carriers are additionally connected to contact legs 11. The contact legs 11 are held in an electrically insulating disc 12 which forms part of a metal screen cap 13. The screen cap 13 is secured to the glass tube by means of a ring-shaped adhesive layer 14.

The contact legs 11 can be secured in a luminaire which delivers current to the lamp 1. The resultant discharge between the electrodes 10 causes the mercury vapor molecules to emit UV light, which is converted to light of the desired wavelength(s) by the fluorescent layer on the inner side of the tube 2.

After ignition of the lamp 1, the electrode 10 begins to glow. The temperature that is reached by the electrode 10 depends on the power sent through the lamp 1. The radiant heat from the electrodes causes, inter alia, the mercury droplets 8 to be heated, as a result of which said droplets evaporate partly. The amount of mercury that evaporates and hence the mercury vapor pressure in the lamp 1 also depends on the temperature of the electrode 10 and the distance between the electrode 10 and the mercury droplets 8. In order to make sure that the mercury vapor pressure in the lamp 1 is approximately constant both at high and low power levels, the electrode carriers 9 are provided with a part that is made of a bimetal or a memory metal, which is formed such that the distance between the electrode 10 and the mercury droplets 8 increases as the temperature increases. The electrode carriers are designed such that, in operation, the temperature of the mercury droplets 8 remains constant, for example 40° C. to 50° C., while the temperature of the electrode 10 may rise to approximately 1000° C. To achieve this, the electrode is allowed to move, between the cold state and the hot state, over a distance of approximately 3 mm to 10 mm.

Preferably a bimetal is used because this leads to a gradual displacement of the electrode. If a memory metal is used, the electrode will move, at a transition temperature, from a first extreme position to a second extreme position.

Figure 2:
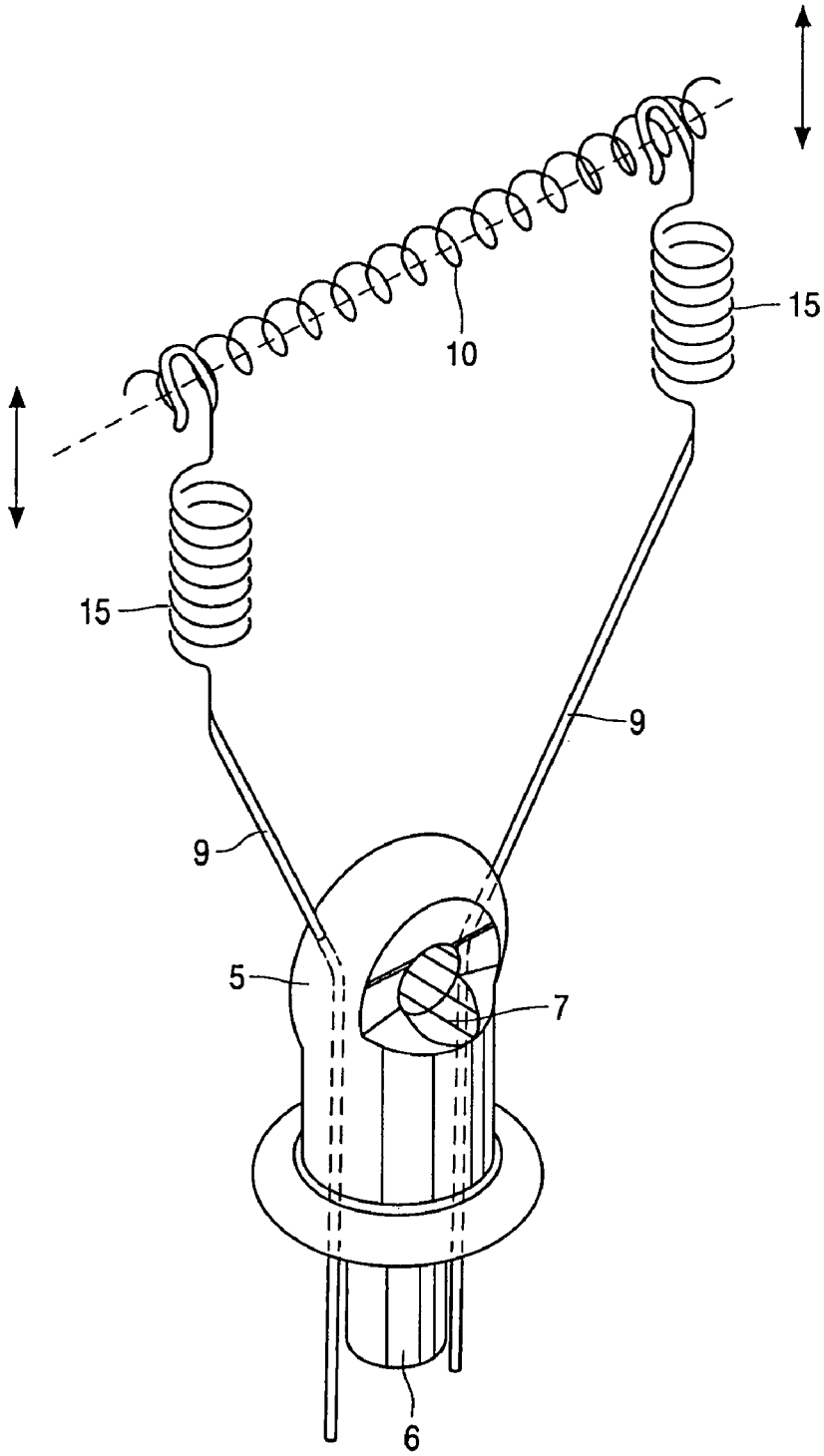
FIG. 2 is a perspective view of a detail of the low-pressure mercury vapor discharge lamp of FIG. 1.
Figure 3:
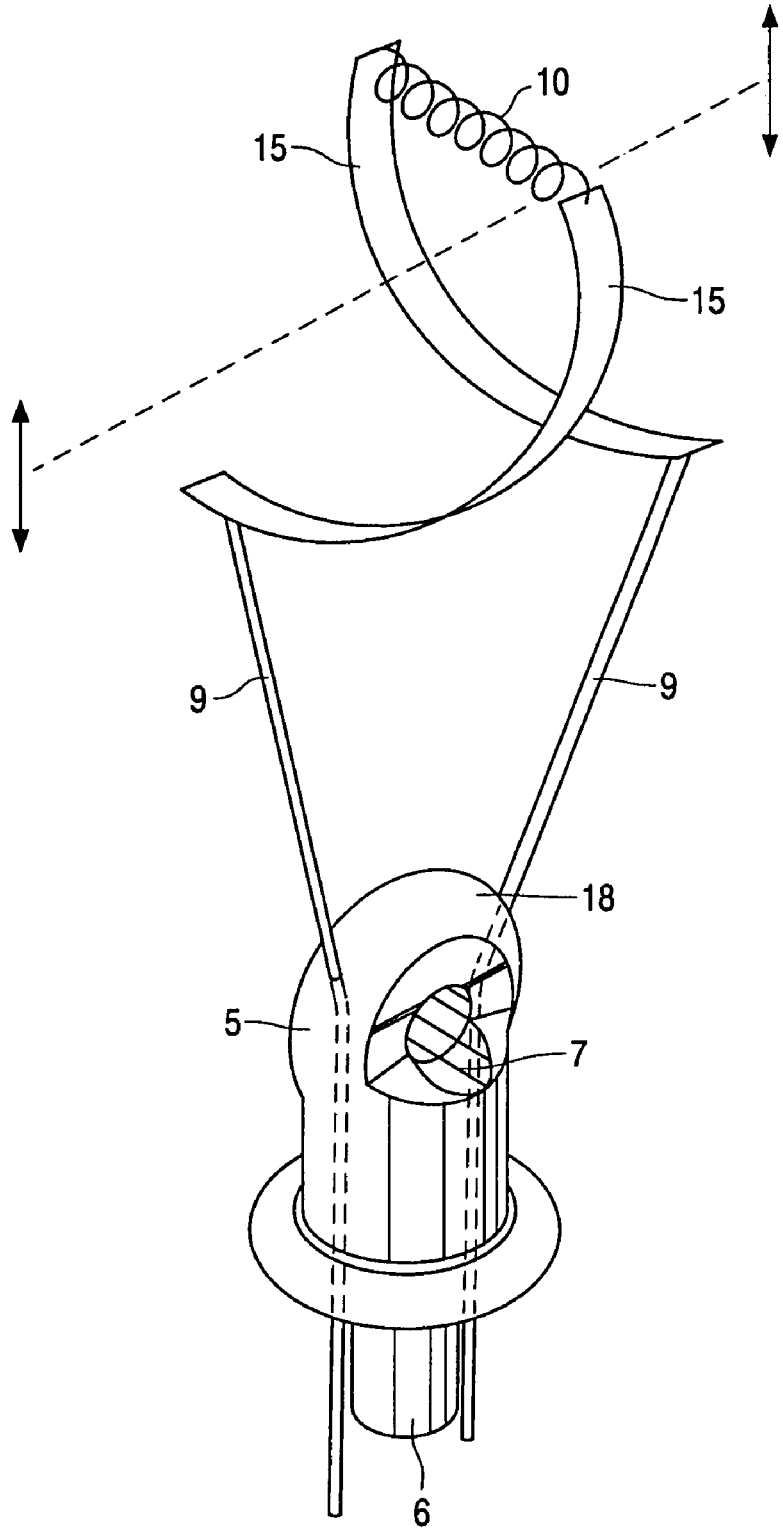
FIG. 3 is a perspective view of a detail of an alternative embodiment of a low-pressure mercury vapor discharge lamp.

In accordance with FIG. 2, the bimetal or memory metal part 15 of the electrode carrier 9 is helical, however, many other shapes are possible. In accordance with FIG. 3, an electrode carrier 9 is composed of a bottom part that is made of a standard metal, and the bimetal parts 15 and the electrode 10 extend substantially in a plane perpendicular to the axis of the discharge vessel 2. Said bimetal parts 15 consist of strips which are more or less curved as a function of temperature. A particularity in this connection is that the thickness and the width of the strip 15 is chosen to be so small that the strip acts as an ohmic resistor, so that the strip is heated not only by radiation and heat conduction originating from the electrode 10 but also directly by the current itself, so that an even larger displacement of the electrode 10 is achieved.

The invention claimed is:

1. A low-pressure mercury vapor discharge lamp comprising a discharge vessel having two end portions, wherein an electrode carrier is arranged in an end portion, which electrode carrier carries an electrode for generating and maintaining a discharge in the discharge vessel, and said electrode carrier is at least partly made of a bimetal or a memory metal, wherein the electrode carrier is configured such that the distance between the electrode and the end of the end portion increases if the temperature of the electrode carrier increases.

2. A low-pressure mercury vapor discharge lamp as claimed in claim 1, wherein the electrode carrier comprises two current supply conductors that deliver current to the electrode.

3. A low-pressure mercury vapor discharge lamp as claimed in claim 2, wherein a sectional dimension of the current supply conductors is configured to cause a temperature of the electrode carrier to increase through electric resistance.

4. A low-pressure mercury vapor discharge lamp as claimed in claim 1, wherein the electrode carrier is configured such that the distance between the electrode and the end of the end portion is increasable by maximally 3–10 mm, as a result of an increase in temperature.

5. A low-pressure mercury vapor discharge lamp as claimed in claim 1, wherein the electrode carrier is at least partly curved in shape.

6. A low-pressure mercury vapor discharge lamp as claimed in claim 1, wherein the electrode carrier is at least partly helical.

7. A low-pressure mercury vapor discharge lamp as claimed in claim 1, wherein the electrode carrier is at least partly spiral-shaped.

8. A low-pressure mercury vapor discharge lamp as claimed in claim 1, wherein the electrode carrier comprises a strip of said bimetal or memory metal that is folded so as to be zigzag-shaped.

9. A low-pressure mercury vapor discharge lamp as claimed in claim 1, wherein the bimetal comprises an iron-nickel alloy.

10. A low-pressure mercury vapor discharge lamp as claimed in claim 9, wherein the active part of the bimetal additionally comprises manganese, copper and/or chromium.

11. A low-pressure mercury vapor discharge lamp as claimed in claim 1, wherein the electrode carrier is configured such that the distance between the electrode and the end of the end portion is increasable by 4–8 mm as a result of an increase in temperature.

12. A discharge lamp comprising:

a discharge vessel having a vessel end;

an electrode; and an electrode carrier configured to carry said electrode, said electrode carrier being located substantially near said vessel end;

wherein said electrode carrier is configured to change shape with variations in temperature of said electrode carrier such that a distance between said electrode and said vessel end changes directly with said variations in temperature.

13. The discharge lamp of claim 12, wherein a dimension of said electrode carrier is configured to cause said temperature to increase through electric resistance.

14. The discharge lamp of claim 12, wherein said electrode carrier is configured such that said distance is increasable by substantially 3–10 mm as a result of an increase in said temperature.

15. The discharge lamp of claim 12, wherein said electrode carrier is configured such that said distance is increasable by substantially 4–8 mm as a result of an increase in said temperature.

16. The discharge lamp of claim 12, wherein said electrode carrier is at least partly curved in shape.

17. The discharge lamp of claim 12, wherein said electrode carrier is at least partly helical.

18. The discharge lamp of claim 12, wherein said electrode carrier is at least partly spiral-shaped.

19. The discharge lamp of claim 12, wherein said electrode carrier is at least partly zigzag-shaped.

20. The discharge lamp of claim 12, wherein said electrode carrier comprises a strip of a bimetal or a memory metal.

* * * * *